US006322071B1

(12) United States Patent
Chaaban

(10) Patent No.: US 6,322,071 B1
(45) Date of Patent: Nov. 27, 2001

(54) AMUSEMENT APPARATUS UTILIZING MULTIPLE BALLS

(76) Inventor: Elias S. Chaaban, 117 Walton Ave., Uniondale, NY (US) 11553

( * ) Notice: Subject to any disclaimer, the term of this patent is extended or adjusted under 35 U.S.C. 154(b) by 0 days.

(21) Appl. No.: 09/480,928

(22) Filed: Jan. 11, 2000

(51) Int. Cl.[7] ..... A63F 9/00

(52) U.S. Cl. ..... 273/138.4; 273/138.1; 273/138.3; 273/144 R

(58) Field of Search ..... 273/138.1, 139, 273/144 R, 144 A, 144 B, 138.2, 138.3, 138.4, 118 R, 118 A, 118 D

(56) References Cited

U.S. PATENT DOCUMENTS

| | | | | |
|---|---|---|---|---|
| 3,534,964 | * | 10/1970 | Guill | 273/144 A |
| 3,638,350 | | 2/1972 | Wiggen . | |
| 3,851,879 | | 12/1974 | Hicks . | |
| 4,395,041 | | 7/1983 | Goldfarb . | |
| 4,508,346 | * | 4/1985 | Salvucci | 273/144 B |
| 4,616,831 | | 10/1986 | Testerman . | |
| 5,056,789 | | 10/1991 | Talbot . | |
| 5,169,317 | | 12/1992 | Hollander . | |
| 5,312,285 | | 5/1994 | Rieber . | |
| 5,370,391 | | 12/1994 | Hilzendeger . | |
| 5,380,007 | * | 1/1995 | Travis et al. | 273/144 B X |
| 5,702,101 | | 12/1997 | Russell . | |
| 5,725,212 | * | 3/1998 | Garrett | 273/144 R |
| 5,735,724 | | 4/1998 | Udagawa . | |
| 6,120,023 | * | 9/2000 | Lai | 273/144 B |
| 6,152,448 | * | 11/2000 | Cudlipp | 273/144 R |

FOREIGN PATENT DOCUMENTS

| | | | | |
|---|---|---|---|---|
| 2245840 | * | 1/1992 | (GB) | 273/144 B |

* cited by examiner

*Primary Examiner*—Raleigh W. Chiu

(57) ABSTRACT

An amusement article utilizing multiple balls comprising: an upper chamber with multiple spherical members of varying sizes colors, all spherical members of the same size bearing the same color, a second chamber located below the upper chamber, and receiving the spherical members from the upper chamber through opening of a valve. A ball distribution device is located within the second chamber and functions to sort all spherical members according to their size and color. Vertical cylindrical chambers are located below the second chamber function to receive the spherical members from the ball distribution device. Each cylindrical chamber receives spherical members of one size and color only. A lower chamber is located below the cylindrical chambers and functions to receive all spherical members through opening of a release member located at a bottom portion of the cylindrical chambers. A bottom reservoir is located below the lower chamber and functions to receive spherical members from the lower chamber. A ball return conduit is connected at one end to the bottom reservoir and at a distal end to the upper chamber. The ball return conduit allows all spherical members in the bottom reservoir to enter the conduit, which allows a user to tilt the amusement device to return all spherical members to the upper chamber.

16 Claims, 6 Drawing Sheets

10

12
14
14
14
16
54
54
54
18
52
24
26B
26C
26A
26D
1
2
3
4
5
6
1
2
3
4
30C
30B
34A
32C
30A
30D
32A
32B
34A
32D
2
3
28A
28B
28C
28D
46A
46B
46C
46D
44A
44B
44C
44D
48A
48B
48C
48D
50D
42
50A
38A
50B
38C
38D
36
38B
20
20B
20A
50
50C
40

10

12
22A
16A
24
22
20
46DA
46DB
46DC
46DE
46DD
42
20
20B
50
40A
40

16

AMUSEMENT APPARATUS UTILIZING MULTIPLE BALLS

BACKGROUND OF THE INVENTION

1. Field of the Invention

The present invention is an amusement device containing multiple colored balls, beads, or other spherical items of various sizes in diameter. In the preferred mode, balls will be of six major colors, each appearing in the rainbow. The balls are kept in a chamber located at the top of the game, and subsequently are released so as to fall downwardly, resembling rainfall. As the balls pass though to a series of cylinders that correspond to each respective color and size, various entertaining actions are triggered, by which a score may be kept by one or more players. In total, the game creates an interesting amusement article for the player, one that is aesthetically pleasing in appearance, and soothing to observe in its operation.

2. Description of the Prior Art

Numerous innovations for small games including balls devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 5,056,789, invented by Talbot entitled "Ball Sequencing Game"

The patent to Talbot describes a game hou arranged vertically underlying one another, with a predetermined column of contrastingly colored or enumerated spheres positioned adjacent the bottommost ramp. The housing includes a slide defining an upper end of the housing, wherein the slide, upon retraction from a first retracted position to a second extended position, permits descent simultaneously of a series of spheres to the uppermost ramp. "L" shaped lever plates are selectively withdrawn from the ramp to permit descent of a predetermined number of spheres from the ramp to ultimately position and arranged the spheres directed along the ramps to align with the aforenoted column of spheres.

2. U.S. Pat. No. 5,702,101, invented by Russell entitled "Handheld Gaming Ball Display Device"

The patent to Russell describes a hand-held character selector and display device for the agitation, random selection and display of spherical objects bearing characters thereon, includes a main housing having disposed therein for random mixing through agitation a plurality of spherical objects bearing characters thereon. A sub-housing, preferably substantially smaller in volume than the main housing, is in communication with the main housing for receiving from the main housing for kinetic energy dissipation a sub-plurality of the spherical objects. A transparent identification chute, preferably substantially smaller in diameter than the sub-housing, is in communication with the sub-housing for receiving from the sub-housing and displaying in alignment a predetermined number of the spherical objects. Agitation means are provided for agitating the spherical objects in the main housing and propelling a sub-plurality thereof into the sub-housing so that the predetermined number of the spherical objects are eventually received in the chute, all within predetermined time constraints.

3. U.S. Pat. No. 5,725,212, invented by Garrett entitled "Random Number Selector"

In the patent to Garrett, a selector a predetermined quantity of numbered spheres or balls which includes a cylindrical housing having an internal storage compartment occupied by the numbered spheres in a liquid solution such as oil. The compartment is connected to a display chamber by a funnel whereby the numbered spheres are introduced to the display chamber in a randomly selected order. At least the display chamber is defined by a transparent window permitting visual observation of the selected spheres. The storage compartment is of greater area than the display chamber and a support base or chain device may support the apparatus.

4. U.S. Pat. No. 5,169,317, invented by Hollander, entitled "Educational Toy"

The Hollander invention comprises a base a base arranged in a generally parallel relationship to each other. The output end of each tubular member is lower than the input end of each tubular member so that balls inserted in the input end flow to the output end. Removable means are provided at the output ends for retaining the balls within the tubular members. Insertion and removal of balls from the tubes by the user improves hand-eye coordination. The toy is usefull in teaching left/right, up/down, and part-whole relationships. The device teaches movement, counting, and color awareness.

5. U.S. Pat. No. 5,370,391, invented by Hilzendeger et al.; entitled "Spiral Slide Ball Game"

The Hilzendeger et al. invention is a game apparatus capable of temporarily storing a plurality of spherical game pieces, and then consecutively and independently releasing each of these game pieces into any one of a plurality of compartments. Included is a spiral passageway and a tubular funnel through which each game piece travels before being randomly directed into one of the compartments. If desired one or more of the compartments could be obstructed to prevent the entrance of game pieces thereinto.

6. U.S. Pat. No. 3,851,879, invented by Hicks, entitled "Game Device With Selectively Moveable Panel Structure"

The patent to Hicks describes a game apparatus including a central transparent upright panel, a pair of outer transparent upright panels on opposite sides of the central panel and selectively movable generally horizontally relative thereto, a plurality of angularly disposed vertically spaced apart and inclined baffle plates between the central panel and each outer panel, and a plurality of game balls movable down the baffle plates between the panels. The outer panels are gravity biased downwardly and inwardly toward the central panel whereby the outer panels will pinch or trap a ball and prevent it from rolling down a baffle plate unless the respective outer panel is selectively moved away from the central wall thus permitting the game ball to roll down a baffle plate. The outer panels are movable relative to the central panel by means of manually operable levers mounted on a base for the game. Two players compete in manipulating their respective movable outer panel in attempting to control the downward speed of their ball along the inclined baffles so as to be the first player to have his ball reach the bottom of the structure. Should a ball be permitted to roll down a baffle too fast, it will fly off the end thereof into a losing chute area.

7. U.S. Pat. No. 5,312,285, invented by Rieber et al., entitled "Descending Ball Game Apparatus"

The patent to Rieber et al. describes a descending ball game apparatus which includes a gate deflect channel member and a pivoting ramp channel member. The gate deflect channel member includes two gates which are positioned adjacent to opposing sidewalls of a channel portion thereof and are operative for deflecting a ball back-and-forth from one sidewall of the channel portion to the other sidewall thereof as the ball descends along the channel portion. The pivoting ramp channel member includes upper and lower level channel segments and a pivoting ramp positioned therebetween. The ramp is operative for receiving a ball descending along the upper level of the channel segment and delivering the ball into the lower level channel segment.

8. U.S. Pat. No. 5,735,724, invented by Udagawa, entitled "Toy Assembly Having Moving Toy Elements"

The Udagawa patent describes a toy assembly provided with manual and electrical operation units which can be selectively actuated to rotate a shaft, which has a helical advancing path, in one direction in an ascending chamber. Toy elements are moved upward in the ascending chamber and descend by gravity along a descending path provided in a descending chamber. The manual operation unit incorporates a first clutch mechanism for disconnecting the manual operation unit from the rotary shaft so as to prevent the rotary shaft to turn in another direction that can move the toy elements downward. A second clutch mechanism is provided to disconnect the rotary shaft from the electrical operation unit when the rotary shaft is driven via the manual operation unit.

9. U.S. Pat. No. 4,395,041, invented by Goldfarb et al., entitled "Ball Transfer and Capture Game and Method"

The patent to Goldfarb et al. describes a game-playing method and apparatus, which includes a frame, one or more sets of balls, and a series of at least three wheels rotatably mounted adjacent to each other on the frame in a common horizontal plane. Each wheel includes a plurality of peripheral ball-carrying pockets having outwardly facing openings. A mechanism mounted in the frame effects continuous rotation of the wheels automatically circulating the balls from wheel to wheel in continuous movement. In particular, the balls are retained in the pockets of a rotating wheel except at transfer zones to adjacent wheels. A ball tends to move out of its pocket whenever it comes to a transfer zone and to pass through that zone to a receiving pocket on the adjacent wheel. If the receiving pocket is already occupied by another ball, no transfer occurs. A manually-actuated stop-gate enables a player to directly control the transfer of balls by blocking or unblocking at least one transfer zone. During the course of a typical game, the balls continuously travel along a path around the wheels and from wheel to wheel, and a player attempts to capture and retain certain balls in particular wheels by selectively opening and closing stop-gates.

10. U.S. Pat. No. 3,638,350, invented by Wiggen, entitled "Toy"

The patent to Wiggen describes a toy of the type in whic or marbles is controlled by manipulation of a ball-supporting surface. A hollow annular casing is supported upon a resilient pedestal with the casing axis in a normally maintained vertical position. By tilting the casing upon its pedestal, balls or marbles within the casing may be set into or maintained in motion in one or more circular paths defined by annular shoulders within the casing.

11. U.S. Pat. No. 4,616,831, invented by Testerman, entitled "Lottery Device"

The Testerman invention is a lottery devic as, but not limited to, operation of a lottery, selecting random numbers, and for making other similar number selections. The device consists of a main base frame, a globe member, a ball selection member, a ball receiving tube, and a plurality of balls sequentially numbered.

As outlined above, the prior art patents that relate to amusement devices or the like largely entail elements such as: manually operated or controlled two player games, improved pinball games, games with electrical operation, games that feature a single descending ball, and several inventions relating to drawing of lottery balls.

In contrast to all of the above, the present invention contains multiple colored balls of various sizes, kept in a chamber at the top of the game, and released to fall downwardly, resembling rainfall. The balls pass to cylinders that correspond to each color and size, automatically triggering multiple actions for amusement purposes. For example, such actions include the spinning of multiple wheels to randomly select numbers printed on the wheels. Such numbers may be used for point-scoring purposes or even for lottery playing purposes.

In addition, the aesthetically pleasing toy or game may act as a stress release for those watching its smooth, relaxing motion. Its overall effect may even be enhanced by including moving colorful figures or by adding sounds that correlate to the graphic theme of the game.

SUMMARY OF THE INVENTION

As noted above, the present invention is an amusement device containing multiple colored balls, beads, or other spherical items of various sizes in diameter. In the preferred mode, balls will be of six major colors, each appearing in the rainbow. The balls are kept in a chamber located at the top of the game, and subsequently are released so as to fall downwardly, resembling rainfall. As the balls pass though to a series of cylinders, preferably between 2 and 12 that correspond to each respective color and size, various entertaining actions are triggered, by which a score may be kept by one or more players.

In a first aspect of the game, the balls hit fins rigidly attached to an axle, allowing the axle to rotate upon impact. A wheel affixed to the axle bears multiple numbers on the outer edge or side thereof. Because this wheel will randomly stop showing a particular number, players may amuse themselves in trying to guess the number that appears. In a second aspect of the game, multiple wheels may appear below the cylinders, such wheels also bearing numbers on the outer edge thereon. These wheels, turned horizontally and perpendicular to the first wheel, will each spin when the balls are released from the cylinders and fall upon them. Once again, users can guess the numbers that will appear when the wheels stop. Users can also add up the numbers appearing on previously selected or designated wheels for the purposes of scoring a unique game. Moreover, if one of the user's numbers matches that appearing on the first wheel mentioned above, additional points may be awarded. In addition, the second group of wheels may even bear the numbers "1" through "54" or the like on the outside edge thereof, allowing the game to randomly pick multiple numbers suitable for playing in a lottery game.

In total, the dynamic nature of the toy allows for entertaining visual effects as well as multiple displays of random numbers. The device is aesthetically pleasing, and may act as a stress release for those watching its smooth, relaxing motion. Finally, the device may even include an audio means, featuring sounds consistent with the graphic theme of the toy itself.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
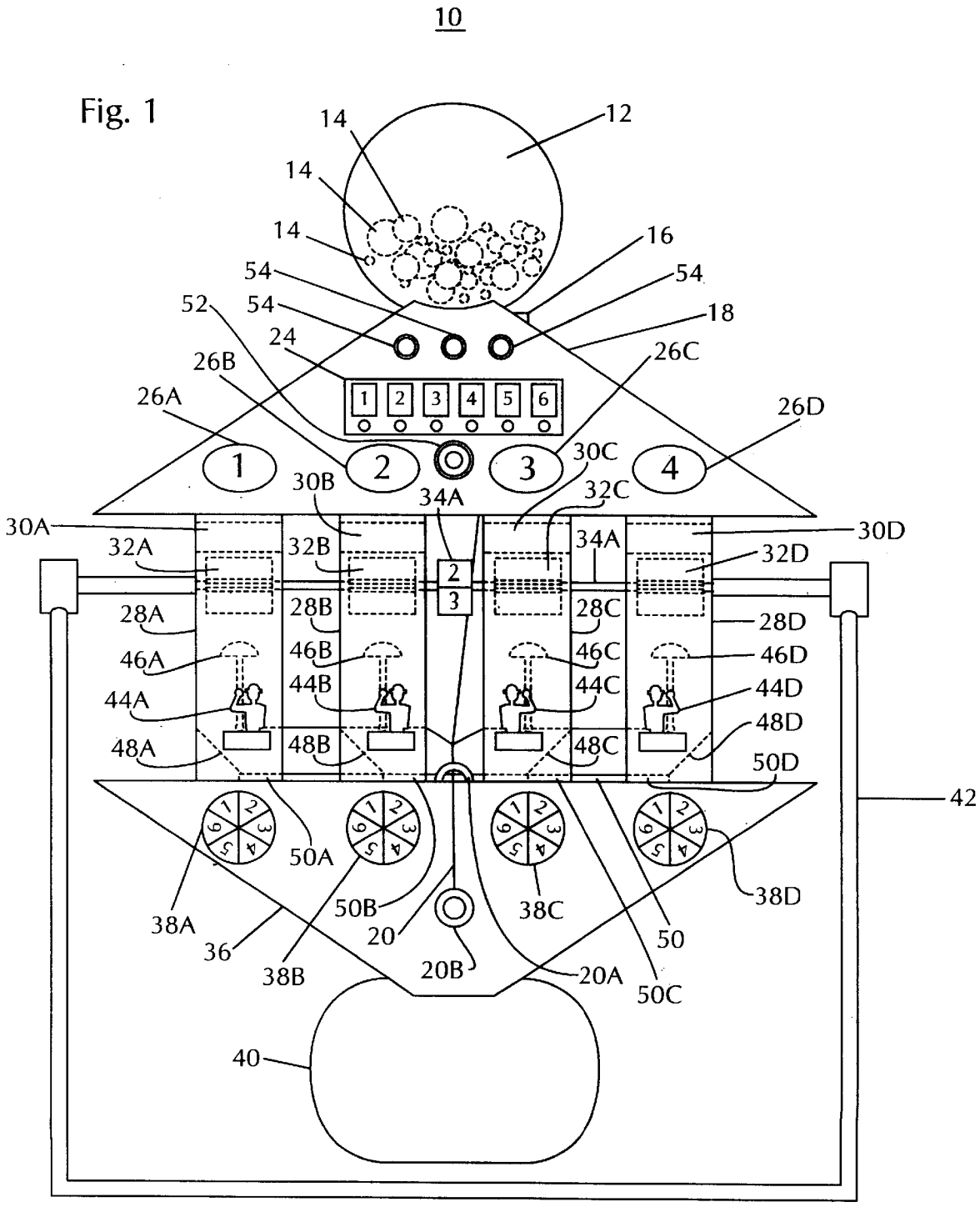
FIG. 1 is a basic front view of the invention, showing the general theme of the game and its principal components. Many differently shaped balls appear in the top portion, several scoreboard numbers appear below such portion, multiple cylinders appear in the middle of the game (bearing optional men with umbrellas), and several numbered wheels appear towards the bottom thereof.

FIG. 1 is a basic front view of the invention, showing the general theme of the game. Many differently sized and colored balls appear in the top portion, several scoreboard numbers appear below such portion, multiple cylinders appear in the middle of the game (bearing optional men with umbrellas), and several numbered wheels appear towards the bottom.

More particularly, the amusement device utilizing multiple balls (10) comprises an upper container (12) which holds therewithin a plurality of spherical objects(14), of several different sizes and several different colors all mixed together.

Such spherical objects may be simply plastic balls or balls manufactured of an equally lightweight substance, or may, in the alternative, be in the form of edible candy. In such an instance, the game may be easily opened by a user to access or such candies at once or the game may include a means to dispense said candies one at a time.

In any such instance, the balls are intended to each be of a solid color, selected from a large array of colors and graphic designs. In the preferred mode, each color of the rainbow will be represented by many balls. In alternate embodiments, many other colors may be used in order to hold the interest of the player.

Regarding the size of the balls, such will be relatively small, such that many of the balls can fit inside of the upper chamber for the greatest visual effect. For instance, each ball may be only several millimeters in diameter, proportional to a size of the total game that is conducive to desktop or tabletop activity. Importantly, all balls of the same color will also be of the same size. For instance, all green balls may be of a diameter of 4 mm, whereas all blue balls may be of a diameter of 5 mm. A general range of 3 mm to 6 mm is preferred, but sizes can vary significantly according to manufacturer preference.

Such balls are released from the upper container (12) by the user engaging pull ring (20B), which is securely attached to string (20). This allows the balls to descend into a second chamber (18) which comprises a ball distribution assembly (16). Both the release mechanism and the ball distribution assembly (16) will be described in detail in connection with other FIGURES herein.

Upon automatically exiting the ball distribution assembly (16) and still traveling in a downward motion, the balls then simultaneously engage first guiding ramp (30A), second guiding ramp [(30B),] third guiding ramp (30C), and fourth guiding ramp (30D). This functions to generally direct the balls downwardly to strike the substantially rear portions of first paddle wheel (32A), second paddle wheel (32B), third paddle wheel (32C), and fourth paddle wheel (32D) respectively. Importantly, all of the aforementioned paddle wheels (32A, 32B, 32C, and 32D) are rigidly affixed to an axle (34), which rotates about a horizontal axis in response to balls striking its attached paddle wheels. Axle (34) also bears a second number wheel (34A) upon it, such second number wheel (34A) rigidly affixed to the axle at a central portion thereof, hence also rotating about the horizontal axis in response to balls striking the paddle wheels. Second number wheel (34A) bears several numbers, such as "1" through "6" upon its outer edge, and functions to allow a user to guess what number will be facing frontwardly when its axle comes to a stop. This creates a unique portion of the game, as a number will always be arrived at in a random manner, due to the unpredictability of the length of time that the axle will be rotating.

The balls (14), now fully separated according to both color and size, descend towards the bottom portions of each cylinder or vertical chamber, stopping at the bottom portion to fill up the cylinders with each respective color and size. The user can then manually release the balls from the vertical chambers or cylinders, which will allow the balls to descend into the lower ball chamber (36). The user accomplishes same by engaging ball release mechanism (50E).

Next, lower ball chamber (36) comprises a first lower paddle wheel (38A) with first number wheel (38AA) thereupon, a second lower paddle wheel (38B) with second number wheel (38BA) thereupon, a third lower paddle wheel (38C) with third number wheel (38CA) thereupon, and fourth lower paddle wheel (38D) with fourth number wheel (38DA) thereupon. Much as was the case regarding the aforementioned number wheel (34A), each of the lower paddle wheels (38A, 38B, 38C, and 38D) will be struck by the descending balls at a generally rear portion thereof. This functions to allow each respective number wheel (38AA, 38BA, 38CA, and 38DA) to spin about a horizontal axis that is oriented ninety degrees off center, or facing a side of the game. This is because each respective number wheel (38AA, 38BA, 38CA, and 38DA) is rigidly attached to each of the respective lower paddle wheels (38A, 38B, 38C, and 38D) at a front portion of the same, and perpendicularly positioned thereupon. Once again, this creates a unique portion of the game, as several numbers will be selected in a random manner, due to the unpredictability of the length of time that the axle will be rotating.

Because several numbers are arrived at randomly, multiple players may use such numbers to create a second aspect of the game. For the purposes of example, a first player may select the left side columns of the game as her own, and a second may select the right side columns of the game as his own. Each player may add up the numbers upon which each of their number wheels stop and may arrive at a total number. Whichever player has a higher total may win this aspect of the game, which may result in a prize that is previously determined. In order to keep track of the same, the game may include a scoreboard (24), preferably located at a top central portion of the device upon chamber (18) for ease of viewing the same. Moreover, each cylinder or vertical chamber may be numbered for organizational purposes, such display numbers (26A, 26B, 26C, and 26D) also appearing above the cylinders upon the outer surface of chamber (18).

Because there is a second set of randomly generated numbers, another game may be played by the users. If a particular player is able to match one of his lower numbers to the number shown on wheel (34A), that player can be eligible to win a certain previously determined prize or point total.

Furthermore, it should be noted that if the game includes a certain amount of such number wheels, the numbers that are randomly selected by the wheels can be used by at least one player for purposes outside the game, such as by playing such numbers in a lottery or other type drawings. This will bring additional amusement and entertainment to the user, who can watch his or her numbers come up on their own.

Still another game may be played if an additional ball or balls are added to the game. For instance at least one "odd ball" for each diameter size that is colored differently than the rest may be included in the mixed ball set up of the upper chamber when the game is commenced. The player who receives a special ball landing the highest on his or her ball heap may be eligible to win a particular point total or prize.

The balls (14) then are allowed to descend into bottom reservoir (40), where the balls (14) are contained until the user manually returns them back to the upper container (12) for beginning another game.

Also illustrated in FIG. 1 are optional indicia and figures that may be included in the game for the purposes of better appealing the game to users in general, or children in particular. For the purposes of example only, the figures shown are persons holding umbrellas, with the umbrellas having the ability to move up and down according to the functionality of the total game. For instance, the game be designed to have the persons' umbrellas automatically lift upon balls descending into each respective chamber, with the umbrellas automatically lowering upon the exit of the balls from the chamber in question. Accordingly, figures (44A, 44B, 44C and 44D) are shown, each bearing respective umbrellas (46A, 46B, 46C, and 46D). Each umbrella comprises a movable top portion (46AA, 46BA, 46CA, and 46DA), as well as a shaft (46AB, 46BB, 46CB, and 46DB), an upper horizontal rod (46AC, 46BC, 46CC, and 46DC), and finally an umbrella handle (46AE, 46BE, 46CE, and 46DE).

Figure 2:
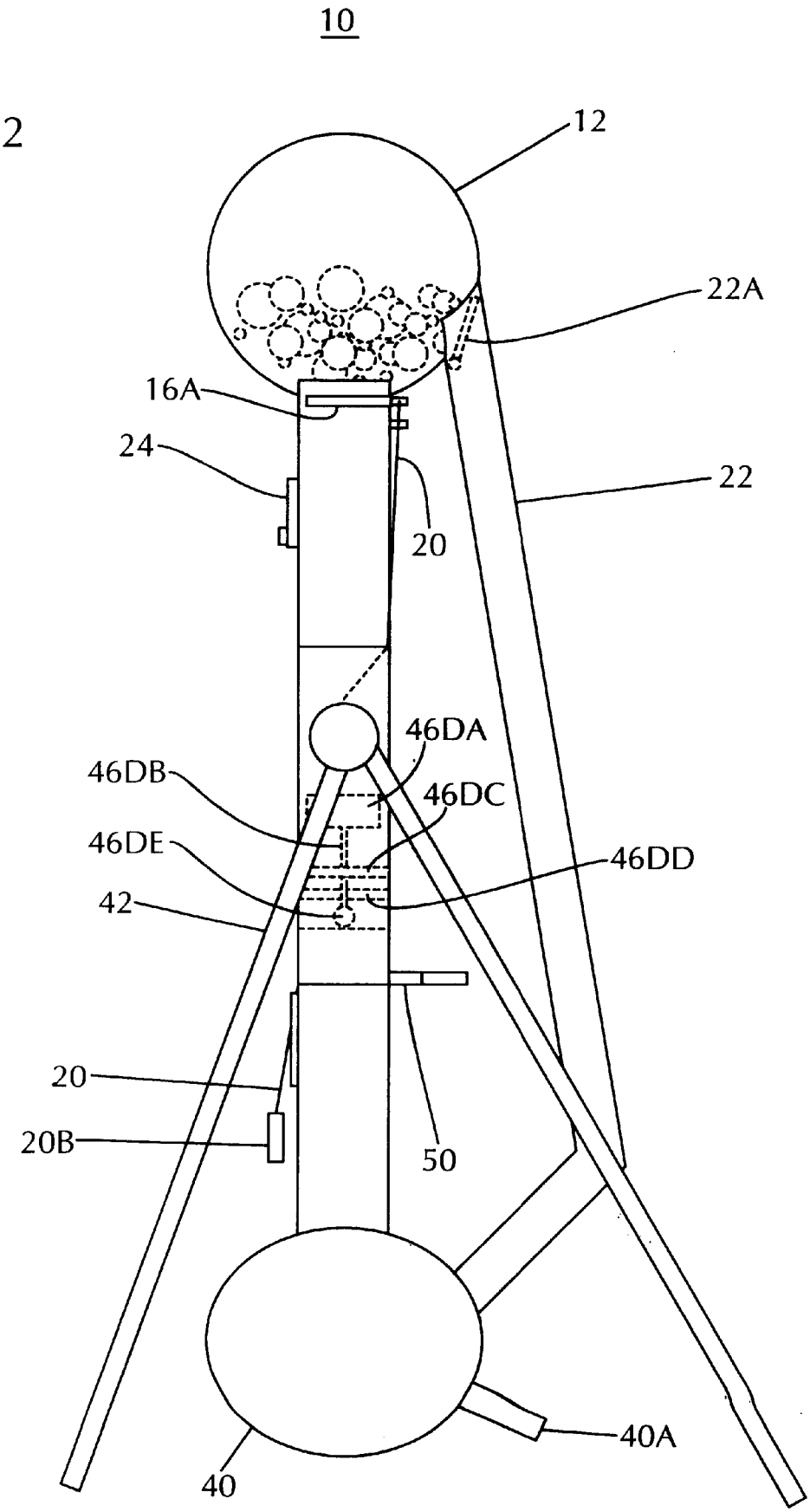
FIG. 2 is a side perspective view of the device, showing one possible path within which the balls may be returned to the top of the game.

FIG. 2 is a basic, simple view of the side of the device, showing one possible path within which the balls may be returned to the top of the game. For the purposes of example, the second cylinder or vertical ball chamber is shown. Illustrated are upper container (12), rear ball return duct (22), valve (22A), second guiding ramp [(30B)], second umbrella top (46B), second slanted guide member [(48B)], manifold control arm (50), ball release mechanism [(50B)], stand (42), second lower paddle wheel (38B), bottom reservoir (40), and grip handle (40A).

Several of the components illustrated in FIG. 2 have been described above with regards to FIG. 1. The valve (22A), shown in this figure only, functions to contain balls (14) within upper container (12), keeping the balls (14) from falling down ball return duct (22) at the start of the game. Importantly, grip handle (40A) allows the user to grasp hold of bottom reservoir (40), tilt the entire game rearwards, and allow the balls (14) to enter the ball return duct (22) so that the balls (14) may be effectively returned to upper container (12). In the preferred mode, the device can be tilted approximately 140 degrees about the vertical axis, for effective ball return therein.

Moreover, as a unique alternate ball return configuration, the present invention may feature a dual handle assembly, whereby a round circle-like rod constructed of plastic or metal lies between said handles. When the user simply grasps the rounded portion and tilts the game, the balls are allowed to easily move from the bottom reservoir to original upper chamber. Such rounded assembly may appear on either side of the game, such that when you roll the object to the left on the ground almost half circle, all balls will roll from bottom to top. As an alternate to this system, two rounded return chambers may appear in the game, one on either side thereof. These double tubes will help facilitate smooth ball movement so that the player can re-start the game in a quick and convenient manner. In this enhanced assembly, a rotating axle may be included in the center of the game device that is connected form the rear of the stand holding the device, such as to allow one to roll the balls upwardly or downwardly in the dual tubes in a free and easy manner.

It is important that during operation of the game the balls not only fall downwardly, but do so according to a particular path that is designed to facilitate general movement of all working parts, and to avoid jamming of the spheres at any given point. For the purposes of example, it is integral tot he system that the balls all fall on the same general side of the paddle wheel elements of the game, such that the paddle wheels, affixed to one another by the same central axle, can all rotate in the same direction (ie. all paddle-type wheels rotating toward the user, or, alternatively, all paddle wheels rotating away from the user. This will allow the wheels to spin smoothly about their axis, leaving the user to only watch the game unfold without having to intervene in any way.

The foregoing is accomplished through the usage of guide-type members within each cylinder or vertical chamber. Specifically, each cylinder comprises a slanted guide member (48A, [48B,] 48C, and 48D for each cylinder) which is positioned diagonally, or slanted along the vertical axis. Thus, the balls (14) will descend through each cylinder, come in contact with these guide members, and be ramped or guided towards a particular point or direction.

Next, the balls (14) will come in contact with guide members that are significantly less sloped than members (48A, [48B,] 48C, and 48D). Such supplemental guide members are numbered (50A, [50B,] 50C, and 50D for each cylinder) and function to further direct the balls toward a back portion of the cylinder, prior to being released from the same.

Positioned horizontally, along the entire rear of the game is a manifold control arm (50). This elongated bar functions to seal off the back of the device, and all of its cylinders or vertical chambers, and further functions to allow the balls to descend in their proper places. The manifold control arm (50) sits parallel to the hard surface upon which the entire game sits, and acts as a support structure for the game itself. Therefore, as the balls (14) pass all of the aforementioned the guide members, they hit the control arm (50) and can then be released from the cylinders in the most optimal position to reach the next compartment and wheels positioned therewithin.

Figure 3:
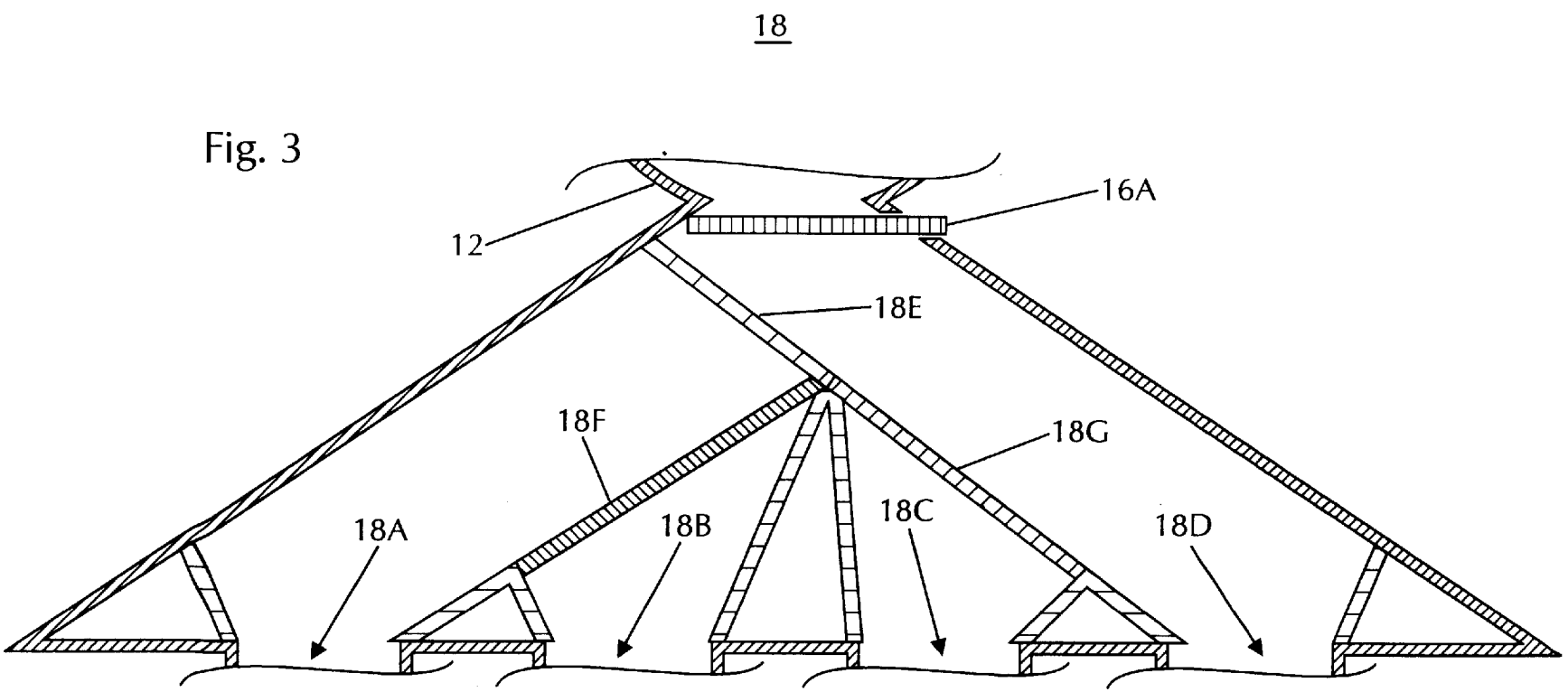
FIG. 3 is a cut-away view of one method in which the game may sort differently sized balls according to their size.

FIG. 3 is a cut-away view of one method in which the game may sort differently sized and colored balls according to their size. Illustrated are upper container (12), ball release valve (16A), second chamber (18), first aperture (18A), second aperture (18B), third aperture (18C), fourth aperture (18D), first ramp (18E), second ramp (18F), and third ramp (18G).

Figure 5:
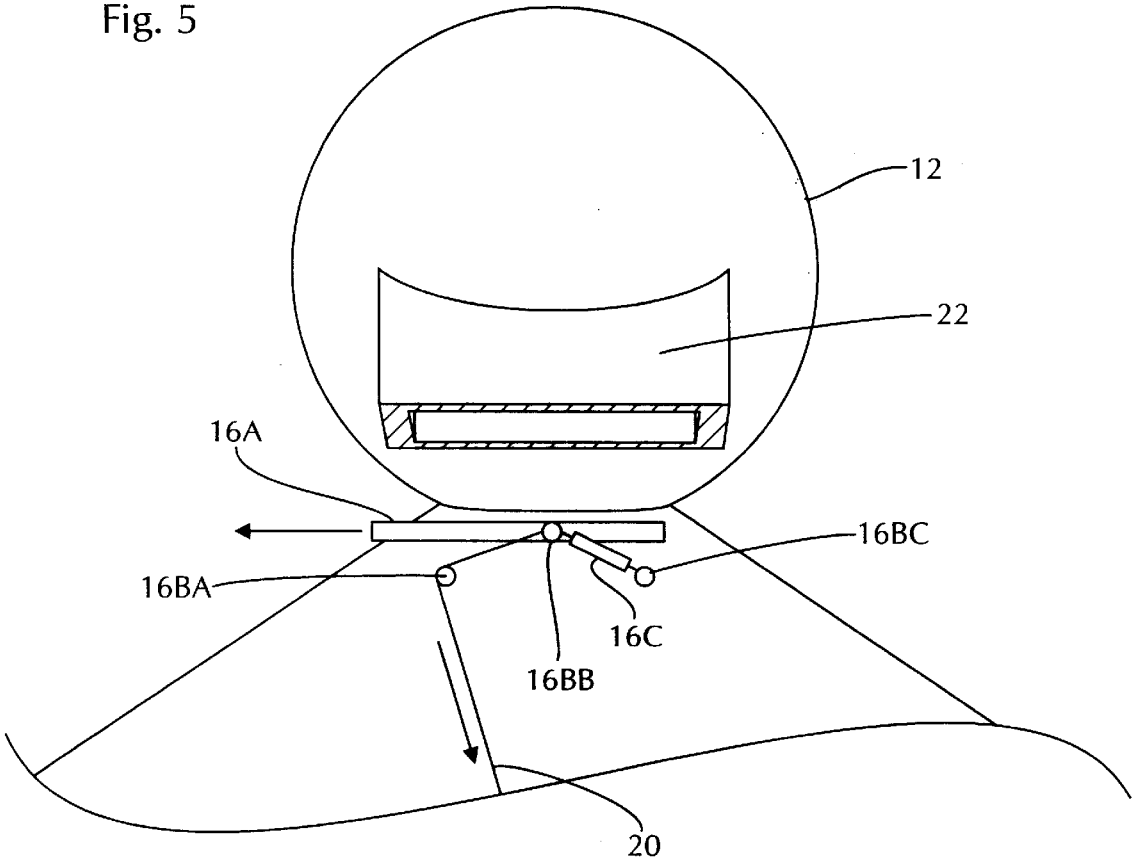
FIG. 5 is a partial cut-away view of one way in which to release the balls from the upper housing to commence the game.

The relationship between upper container (12) and ball release valve (16A) is illustrated in greater detail in FIG. 5 herein. For the purposes of FIG. 3, ball release valve (16A) allows the balls (14) to enter the general area noted as (18). At this point, as previously noted, the multiple colored balls are of several different sizes, each spherical object with a diameter slightly larger than the previous. As all of the balls (14) descend into the are designated as (18) via simple gravity, the balls (14) first encounter the ramp-like component described herein as first ramp (18E). First ramp (18E) will function as a first or primary distribution means for the balls (14) according to their size, and therefore according to their color.

Specifically, first ramp (18E) will divide the balls (14) into two separate groups, represent fifty percent of the balls (14) in each group. Importantly, due to the size and overall construction of first ramp (18E), half of the balls (14)—the smaller ones—will be allowed to pass first ramp (18E) and move towards the left portion of the total device depicted in FIG. 3. In other words, the smallest of the spheres will not be stopped by first ramp (18E), but instead will pass by first ramp (18E) and continue to descend, this time on the left half of FIG. 3.

Now falling upon the left half of FIG. 3, the subset of smaller balls will subdivide once again according to size, and hence color, this time due to the size and overall construction of second ramp (18F). Much as in the case of the above, second ramp (18F) is so small that it too will not be able to stop the very smallest balls, which will, due to simple gravity and descending motion, pass by second ramp (18F) and continue downwardly.

Second ramp (18F) will, however, stop some of the balls according to their exact diameter and size, and will route those balls downwardly towards the bottom left of FIG. 3. It is important to note that such ramp members may be at varying angles of pitch or incline, as manufacturers of the game see fit. An optimal angle of incline that both serves to move the balls at a comfortable speed and prevents the same from being jammed is of course desired.

As one can see from the main components of FIG. 3, parts (18A, 18B, 18C, and 18D) represent the entry to the four cylinders or vertical chambers illustrated in FIG. 1. Due to the above-described ball distribution mechanism, all balls entering first aperture (18A) will be of the exact size (and hence exact color) as one another. Likewise, all balls entering second aperture (18B) will be of the exact size (and hence exact color) as one another, all balls entering third aperture (18C) will be of the exact size (and hence exact color) as one another, and finally all balls entering fourth aperture (18D) will be of the exact size (and hence exact color) as one another.

In the preferred mode of production, the chamber (18) comprises a front facing exterior wall that is opaque. This is so that the user can not see the ball distribution means behind the opaque wall, building great intrigue and interest in how the previously mixed balls all are perfectly separated according to color, in only several moments. However, the game may be produced in an alternate mode with a translucent or transparent exterior chamber wall, such that users can see exactly how the distribution system works, for extra interest and excitement.

Figure 4:
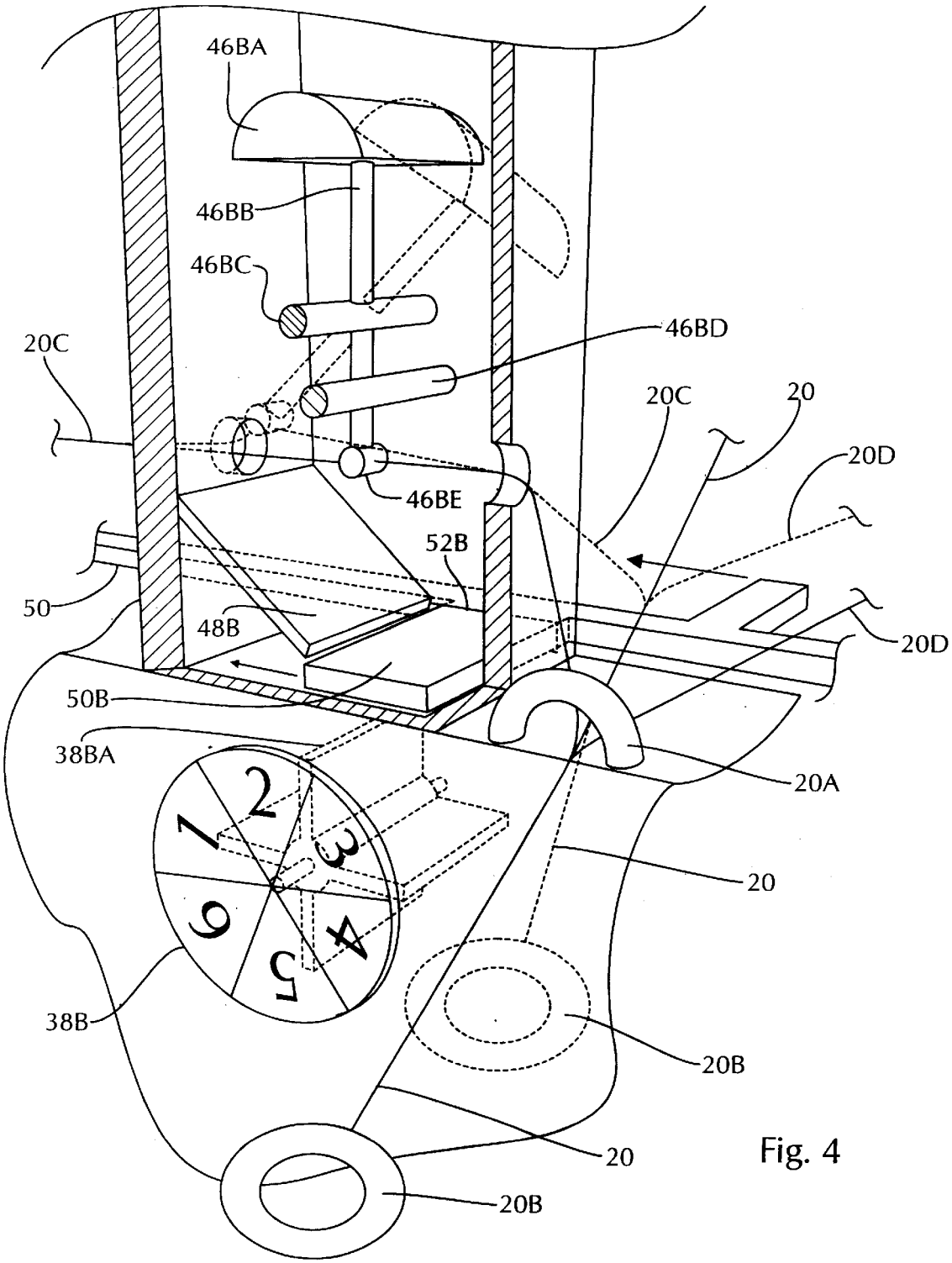
FIG. 4 is a partial cut-away view of the invention, showing one possible means by which the "number wheel" may be operated and umbrellas may be lifted and dropped.
Figure 4A:
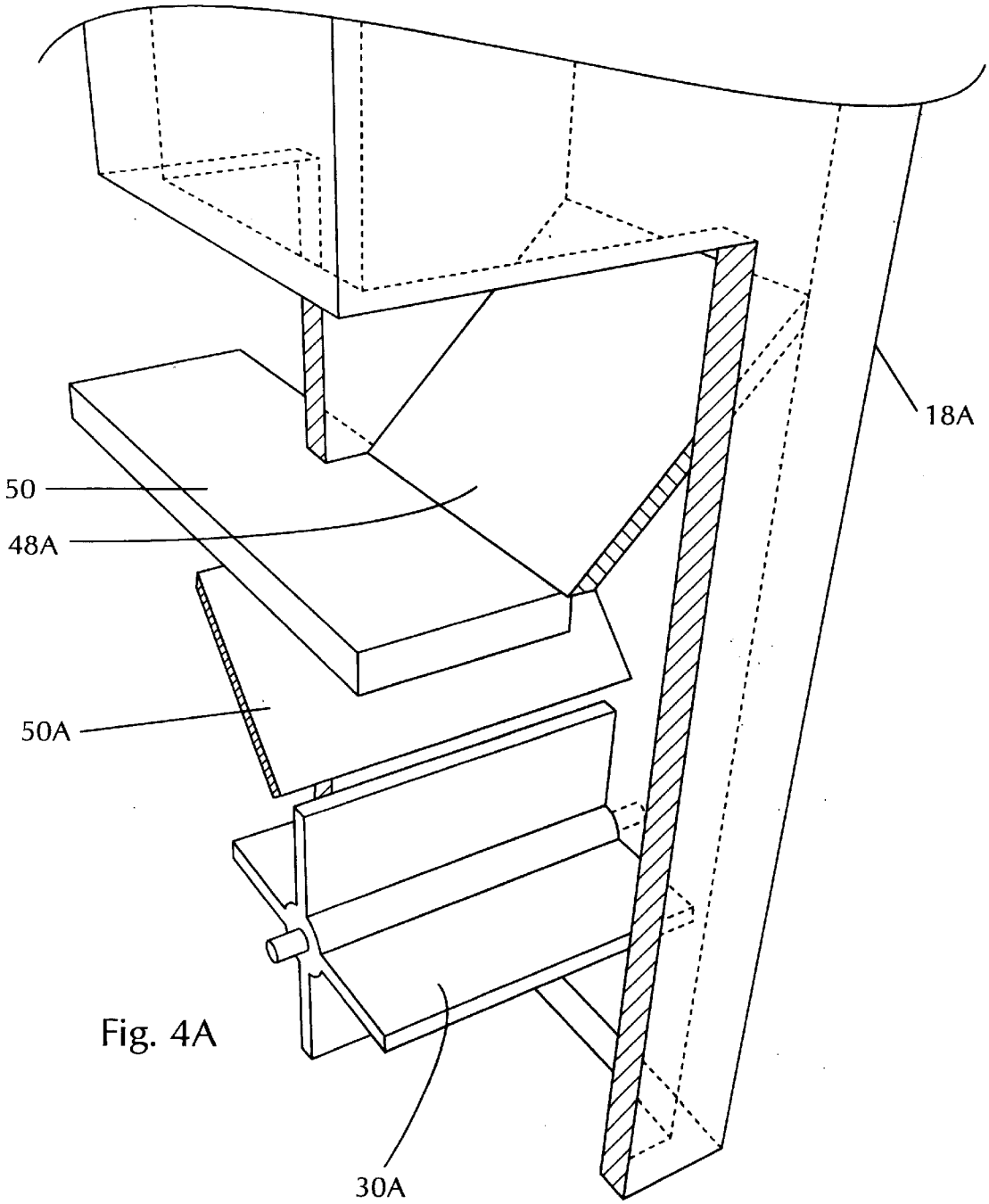

FIG. 4 is a partial cut-away view of the invention, showing one possible means by which the "number wheel" may be operated, and umbrellas may be lifted and dropped. Illustrated are string mechanism (20), guide mechanism (20A), pull ring (20B), first string member (20C), and second string member (20D). Also shown are ball release mechanism (50E), manifold control arm (50), second umbrella top (46B), second horizontal member [(50B)], second lower paddle wheel (38B), second number wheel (38BA), umbrella top portion (46BA), umbrella shaft (46BB), upper horizontal rod (46BC), lower horizontal rod (46BD), and umbrella handle (46BE).

For the purposes of example, FIG. 4 shows the "B" cylinder, or the vertical chamber that is immediately off center of the game to the left. As shown, umbrella handle (46BE), umbrella shaft (46BB), and umbrella top portion (46BA) are rigidly affixed to one another and will all move when the umbrella is engaged. Upper horizontal rod (46BC) and lower horizontal rod (46BD) together function to keep the umbrella within a previously determined range, such that the umbrella can not completely fall over to the right or to the left. Guide mechanism (20A) functions to hold string (20) in a general position, preventing the string (20) from falling off course. Upon the user pulling pull ring (20B), first string member (20C) and second string member (20D) move to the left and to the right respectively, such that the umbrella will ascend when the balls are dropped into the cylinder and descend when they are past the figure holding the umbrella, simulating the end of falling rain. Regarding graphics to accompany the umbrella, such may be in the form of a humorous figure on a balcony holding the umbrella, which may be painted of otherwise affixed to the back of the cylinders.

FIG. 5 is a partial cut-away view of one way in which to release the balls from the upper housing to commence the game. Illustrated are upper container (12), ball distribution assembly (16), ball release valve (16A), left pulley point (16BA), middle pulley point (16BB), right pulley point (16BC), spring member (16C), string mechanism (20), and rear ball return duct (22).

In one example, when the user manually pulls the string (20), string (20) moves downwardly past left pulley point (16BA), to the left past middle pulley point (16BB), and moves ball release valve (16A) to the extreme side of the game. This creates an aperture immediately below upper container (12), which functions to allow the balls (14) to drop downwardly into the chamber (18), and hence the balls distribution assembly (not shown in FIG. 5). Spring member (16C) is included between middle pulley point (16BB) and right pulley point (16BC) as one example of a means to facilitate movement of the ball release valve (16A). In another method, left pulley point (16BA) and spring (16C) are positioned further to the left and middle pulley point (16BB) is not used, creating an additional simplified means of releasing the balls from the upper chamber (12).

It should also be noted that the game of the present invention may include an audio means (52) in order to enhance the overall effects thereof. For instance, the game may include sounds relating to the theme depicted graphically, such as sounds of thunder and lightning, wind, or rain itself in a general rain theme of the game. In addition, the game may also include songs played, which may relate to the theme depicted as well.

In addition, the game may include an illumination means (54), functioning to light parts or all of the game so that the same can be played in the dark, or simply to enhance its overall appearance. In order to accomplish either of the above, the game may include a power source, such via electrical means. In any such instance, the optional power means may also function to control certain aspects of the game automatically, such as the return of the balls to the original upper chamber.

Moreover, it is imperative to understand that the game may be produced in virtually any size, ranging from a small desk-top arrangement, to a larger device that can be used for display to many persons. In addition, almost any materials of construction may be used to create the game, provided that the same are generally lightweight, durable, and relatively cost-effective.

Finally, one must realize that in addition to amusement and entertainment, the game of the present invention provides a unique form of stress release and several emotional benefits. Watching all of the mixed colored balls magically divide and sort out into separate chambers of separate colors is soothing, relaxing, and creates a great feeling of resolve. Users of all ages can enjoy the benefits of this interesting and calming device at home or in the office, and may purchase several different variations of the game based upon particular consumer preferences.

With regards to all FIGURES, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by letters patent is set forth in the appended claims:

What is claimed is:

1. An amusement article utilizing multiple balls comprising:

A. an upper chamber, which comprises a plurality of spherical members, the spherical members of varying sizes in diameter and of varying colors, all spherical members of the same size bearing the same color thereupon;

B. a second chamber located at a position below the upper chamber, the second chamber receiving the spherical members from the upper chamber through opening of a valve member;

C. a ball distribution device located within the second chamber, the ball distribution device functioning to sort all spherical members according to their size and color;

D. a p f vertical cylindrical chambers located at a position below the second chamber, the cylindrical chambers functioning to receive the spherical members from the ball distribution device, each cylindrical chamber receiving spherical members of one size and color only;

E. a lower chamber located at a position below the plurality of cylindrical chambers, the lower chamber functioning to receive all spherical members from the cylindrical chambers through opening of a release member located at a bottom portion of the cylindrical chambers;

F. a bottom reservoir located at a position below the lower chamber, the bottom reservoir functioning to receive spherical members from the lower chamber; and G. a ball return conduit connected at one end to the bottom reservoir and at a distal end to the upper chamber, the ball return conduit functioning to allow all spherical members in the bottom reservoir to enter the conduit, allowing a user to tilt the amusement device about its vertical axis to return all spherical members to the upper chamber.

2. The amusement article utilizing multiple balls as described in claim 1, wherein the number of cylindrical chambers is selected from a group consisting of two, three, four, five, six, seven, eight, nine, ten, eleven, and twelve.

3. The amusement article utilizing multiple balls as described in claim 1, wherein the colors of spherical members are selected from the group consisting of red, orange, yellow, green, blue, and violet.

4. The amusement article utilizing multiple balls as described in claim 1, wherein the amusement article comprises an audio means which functions to provide sounds consistent with a previously determined theme.

5. The amusement article utilizing multiple balls as described in claim 1, wherein the amusement article comprises an illumination means which functions to provide lighting consistent with a previously determined theme.

6. The amusement article utilizing multiple balls as described in claim 1, wherein the article comprises a scoreboard, which functions to allow users to track scores achieved during playing of at least one game utilizing the article.

7. The amusement article utilizing multiple balls as described in claim 1, wherein the article comprises a stand which functions to allow the article to be placed upon a flat surface.

8. The amusement article utilizing multiple balls as described in claim 1, wherein the spherical members are of an edible candy construction.

9. The amusement article utilizing multiple balls as described in claim 1, wherein the second chamber comprises a front exterior wall that is selected form the group consisting of opaque, translucent, and transparent.

10. The amusement article utilizing multiple balls as described in claim 1, wherein the article comprises a power means, which functions to return all spherical members from the bottom reservoir to the upper chamber automatically.

11. The amusement article utilizing multiple balls as described in claim 1, wherein spherical members are released from the upper container by the user engaging pull ring, which is securely attached to a string that is connected to a valve release member.

12. The amusement article utilizing multiple balls as described in claim 1, wherein the spherical members are of a size in the range of 3 mm to 6 mm.

13. The amusement article utilizing multiple balls as described in claim 1, wherein the device comprises at least one axle which rotates about a horizontal axis, each axle comprising at least one paddle wheel thereupon, each paddle wheel comprising a number wheel thereupon, each wheel rigidly affixed to each paddle wheel and axle at a central portion thereof, hence rotating about the horizontal axis in response to spherical members striking the paddle wheels and rotating same.

14. The amusement article utilizing multiple balls as described in claim 13, wherein each number wheel bears numbers 1 through 6 thereupon, the occurrence of such numbers to be utilized for at least one game to be played by at least one player.

15. The amusement article utilizing multiple balls as described in claim 13, wherein a player seeks to match like numbers occurring on the number wheels.

16. The amusement article utilizing multiple balls as described in claim 13, wherein each player adds numbers from number wheels together to result in a total score to be used in at least one game.

* * * * *